US005152619A

United States Patent [19]

Niikawa et al.

[11] Patent Number: 5,152,619

[45] Date of Patent: Oct. 6, 1992

[54] DOT-MATRIX PRINTER WITH DOT COUNTER AND TEMPERATURE SENSOR FOR EFFICIENT HIGH-QUALITY PRINTING

[75] Inventors: Takeshi Niikawa; Masashi Suzuki, both of Nagoya, Japan

[73] Assignee: Brother Kogyo Kabushiki Kaisha, Nagoya, Japan

[21] Appl. No.: 645,484

[22] Filed: Jan. 24, 1991

[30] Foreign Application Priority Data

Mar. 22, 1990 [JP] Japan ..... 2-72779

[51] Int. Cl.[5] ..... B41J 2/30

[52] U.S. Cl. ..... 400/124; 400/54

[58] Field of Search ..... 400/54, 124 TC

[56] References Cited

U.S. PATENT DOCUMENTS

| | | | |
|---|---|---|---|
| 3,577,137 | 5/1971 | Brennan, Jr. | 340/324 |
| 4,473,311 | 9/1984 | Sakaida | 400/124 |
| 4,637,742 | 1/1987 | Sakai | 400/121 |
| 4,653,940 | 3/1987 | Katsukawa | 400/54 |
| 4,978,239 | 12/1990 | Alexander | 400/54 |
| 5,059,044 | 10/1991 | Takaishi | 400/54 |

FOREIGN PATENT DOCUMENTS

| | | | |
|---|---|---|---|
| 158075 | 7/1987 | Japan | 400/124 TC |
| 62-189172 | 8/1987 | Japan | 400/124 |
| 62-189173 | 8/1987 | Japan | 400/124 |
| 202752 | 9/1987 | Japan | 400/124 TC |
| 279976 | 12/1987 | Japan | 400/124 TC |

*Primary Examiner*—David A. Wiecking
*Assistant Examiner*—Steven S. Kelley
*Attorney, Agent, or Firm*—Oliff & Berridge

[57] ABSTRACT

A dot-matrix printer with a print head having plural print elements which are disposed in a row and selectively activated to form a dot or dots in a vertical row of a dot matrix pattern representing a character, having a device for adding to a content of a memory the numbers of dots which are formed by the elements; a device for measuring a time lapse; a temperature sensor for sensing a temperature of the print head; a device for substracting a predetermined value based upon the temperature sensed by the temperature sensor at predetermined time intervals; a device for checking whether the content of the memory has exceeded a reference value; and a control device for controlling the print head so as to cool the print head if the content of the memory has exceeded the predetermined value.

13 Claims, 8 Drawing Sheets

DOT-MATRIX PRINTER WITH DOT COUNTER AND TEMPERATURE SENSOR FOR EFFICIENT HIGH-QUALITY PRINTING

BACKGROUND OF THE INVENTION

1. Field of the Invention

The present invention relates generally to a dot-matrix printer capable of printing characters, such as letters, symbols and graphical representations, with a matrix of dots. More particularly, the invention is concerned with such a dot matrix printer which is free from printing troubles due to a drop in drive voltage of a print head, or an abnormal rise in temperature of the print head, when dots are formed continuously with a relatively high density.

2. Description of Related Art

In a common dot-matrix printer, print elements provided on a print head are disposed in a row and selectively activated to form dots in a vertical row of a dot matrix pattern corresponding to a character.

When dots are printed continuously with a high density, the temperature of the print head rises excessively. As a result, the excitation coils of the print head drive circuit are broken due to the excessive rise in the temperature. In addition, soldered joint portions melt so that joints separate.

In the art of dot-matrix printing, it is also recognized that excessive temperature rise of a print head results in poor printing quality. More specifically, in the case of a wire-dot printer, the insulating characteristic of insulators for solenoids that activate the print wires is reduced when the temperature of the print head is excessively elevated. Consequently, the solenoids may fail to be energized as required, whereby the corresponding dots may not be formed. Further, an excessive rise of the print head temperature causes the thermal ribbon to be fused by portions of the print head other than the activated heat-generating elements. In this case, a print sheet or other recording medium is soiled with ink or the characters may not be printed clearly.

A control arrangement for a dot-matrix printer to solve the above-mentioned problem is proposed in Japanese Unexamined patent application No. 59-234732, filed in 1984, which was laid open to public inspection on May 30, 1986 under Provisional Publication No. 61-112649 and corresponds to U.S. patent application Ser. No. 779,095 filed Sep. 23, 1985, now U.S. Pat. No. 4,653,940. These applications were filed by the same assignee who files the present application.

In the dot-matrix printer constructed as described above, the number of dots which are formed by the activated print elements is added to the current content of the dot-number memory in order to sum up the amount of heat generated by the print head. To better define the heat generated, a predetermined number is subtracted from the current content of the dot-number memory in order to compensate for the amount of heat (which has been generated in the print head) which is dissipated in each lapse of the predetermined time interval. In other words, the predetermined number to be subtracted is equivalent to the sum of heat dissipated in the predetermined time interval. Accordingly, the current content of the dot-number memory represents the current amount of heat accumulated in the print head. For this reason, the temperature of the print head or the amount of heat accumulated in the print head may be estimated by judging whether the current content is greater than a reference value. If it is judged that the current content of the dot-number memory has exceeded the predetermined reference value, a special printing mode is executed to cool the print head.

However, as a result of the continuous study made by the assignee of the present application, it is known that above mentioned printer has a problem. That is, the reference value selected is so small that the temperature of the print head does not rise, in any case, higher than an allowed temperature when the judging means judges the current content of the dot-number memory has reached the reference value.

Therefore, the special printing mode is executed before the temperature of the print head has increased appreciably. When printing data comprising many printing dots are transmitted from the host computer shortly after the power has been supplied, the current content of the dot-number memory exceeds the reference value and the special printing mode is executed even through the temperature of the print head is still low. Thus, the printing speed is decreased below the normal value and the efficiency of the printing operation is reduced.

An object of the present invention is to provide a dot-matrix printer which is able to form continuously high quality letters, symbols and graphical representations without the identified printing problems normally associated with an excessive rise in the temperature of the print head. This is done by counting the number of dots to be printed and keeping printing speed normal even when the counted number of dots are a large value if the temperature of the print head has not yet risen or has risen by a minor amount.

According to the present invention, there is provided a dot-matrix printer including a print head having plural print elements which are selectively activated, during movement of the print head, to form a dot or dots in a vertical row of a dot matrix pattern representing a character, comprising: a dot-number memory; adding means for adding to a current content of the dot-number memory the number of dots which are formed by the print elements during movement of the print head; time-measuring means for measuring a time lapse; subtracting means for subtracting a predetermined value from the current content of the dot-number memory each time the time-measuring means has measured a predetermined time interval; a temperature detecting means for detecting a temperature of a print head; a subtraction value changing means for changing a subtraction-value to be subtracted from the current content of the dot-number memory according to the temperature detected by the temperature detecting means; judging means for checking whether the current content of the dot-number memory has exceeded a predetermined reference value; and printing control means for controlling the print head so as to cool the print head if the judging means has judged that the current content of the dot-number memory has exceeded the predetermined reference value.

In such a manner, when the current content of the dot-number memory exceeds the predetermined reference value a special printing mode is executed to cool the print head. As a result, the dot-matrix printer of this invention can print characters such as letters, symbols and graphical representations of high quality and yet be freed from the printing problems caused by an excessive rise in the temperature of the print head. This is accomplished by using a subtraction value changing means to change the subtraction value to a preferable value according to the temperature detected by a temperature detecting means. Thus, the value in the dot-number memory is kept at the preferable value when the temperature of the print head does not rise excessively. Consequently, the special print mode is not executed when the temperature of the print head rises normally. Accordingly, printing speed is kept at the standard speed when the temperature of the print head is in a normal range.

BRIEF DESCRIPTION OF THE DRAWING

The foregoing and other objects, features and advantages of the present invention will become more apparent from reading the following description of preferred embodiments of the invention, when considered in connection with the accompanying drawings, in which.

DETAILED DESCRIPTION OF THE PREFERRED EMBODIMENTS

To further clarify the concept of the present invention, a preferred embodiment of the invention will be described in detail, by reference to the accompanying drawings.

Figure 2:
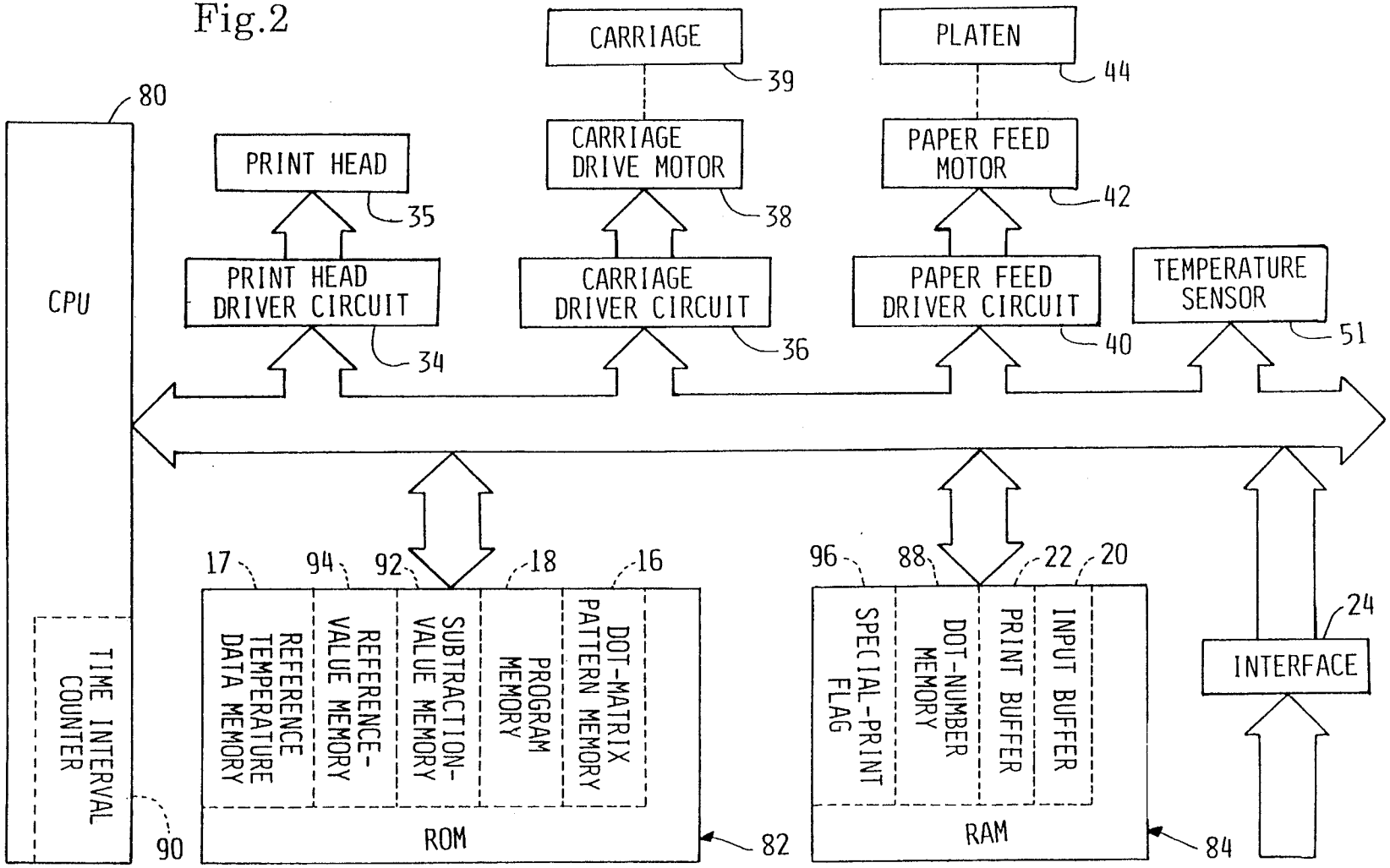
FIG. 2 is an electric block diagram of a control system of the dot-matrix printer of the invention.

FIG. 2 shows a control system for the present invention. A central processing unit (hereinafter simply referred to as "CPU") 80 is connected, via an interface 24 and a data bus, to an external device such as a host computer. The CPU 80 is further connected to a read-only memory 82 (hereinafter called "ROM"). The ROM 82 includes a dot-matrix pattern memory 16, a reference temperature data memory 17, a program memory 18, a subtraction-value memory 92, and a reference-value memory 94. The dot-matrix pattern memory 16 stores dot-matrix pattern data which represent dot-matrix patterns corresponding to the characters such as letters, digits, symbols and graphic representations. The reference temperature data memory 17 stores reference temperature data which corresponds to a temperature used for comparing with a temperature determined by a temperature sensor 51 as described below. The program memory 18 stores various programs for controlling printing operations of the printer which will be described in detail.

The subtraction-value memory 92 stores a subtraction value Na which is a predetermined value to be subtracted from the current content of the dot-number memory 88. The subtraction value, Na, is the maximum number of dots which can be formed continuously during a predetermined time, where the amount of heat generated in the print head is substantially equal to an amount of heat dissipated from the print head. Therefore, there should not be any printing failures or inconveniences due to an excessive rise in the temperature of the print head. Accordingly, if the number of dots to be formed during the predetermined time has not exceeded the subtraction value Na, the print head 35 keeps printing continuously and stably without any printing failure due to an excessive rise in the temperature of the print head 35. The reference-value memory 94 contains data concerning a predetermined reference value Ns. When more than the subtraction data Na number of dots are printed during the predetermined time, some of the heat generated by driving the print head 35 is stored in the print head 35. If more than the subtraction data Na of dots are continually printed, the heat stored in the print head 35 increases. When the total of the number of dots printed in excess of the subtraction value Na during the predetermined time exceeds the predetermined reference value Ns, trouble with printing operations may result because of the excessive heat stored in the print head 35. A reference temperature data memory 17 stores data concerning a reference temperature Ts. When the temperature in the print head 35 has exceeded the reference temperature Ts, the subtraction value to be subtracted is changed. In this embodiment, the reference temperature data Ts is 150 degrees centigrade. But the reference temperature Ts is not limited to the above mentioned temperature.

The RAM 84 includes an input buffer 20, a print buffer 22, a dot-number memory 88, and a special-print flag 96. The input buffer 20 temporarily stores printing data corresponding to a line of characters which are transferred from the external device via the interface 24. The print buffer 22 temporarily stores dot-matrix pattern data for one line which corresponds to the input printing data stored in the input buffer 20 and which has been retrieved from the dot-matrix pattern memory 16 based on the printing data in the input buffer 20.

The dot-number memory 88 stores a sum of the numbers of dots N which are formed by the print head 35, as will be described later in detail. Upon starting a printing cycle, the dot-number memory 88 is set at a predetermined initial value.

In the present embodiment, this predetermined initial value is "0". If the sum of the number of dots N stored in the dot-number memory 88 has exceeded the predetermined reference value Ns stored in the reference-value memory 94 before the execution of printing one line, a special-print flag 96 is set. During the printing operation, the CPU 80 adds the number of dots printed to the sum of the numbers of dots N stored in the dot-number memory 88 based on the dot pattern data of the print buffer 22.

The CPU 80 further has a time-interval counter 90 which measures a time lapse from the start of a printing cycle. Each time the time-interval counter 90 has measured a predetermined time interval, a predetermined value is subtracted from the current content of the dot-number memory 88. In the present embodiment, the above predetermined time interval is selected to be 9 msecs. The predetermined value is subtracted at the time intervals of 9 msecs from the sum of the numbers of dots N stored in the dot-number memory 88.

The CPU 80 also determines the temperature of the print head 35 detected by a temperature sensor 51 whenever the predetermined time lapses and changes the subtraction value Na to the predetermined value, Na or 2Na, according to the sensed temperature. Namely, if the sensed temperature T of the print head 35 is less than or equal to the reference temperature Ts, the CPU 80 (the subtraction means) subtracts twice the subtraction value Na from the current content of the dot-number memory 88. On the other hand, if the sensed temperature T of the print head 35 has exceeded the reference temperature Ts, the CPU 90 (the subtracting means) subtracts the subtraction value Na from the current content of the dot-number memory 88. In the present embodiment, this subtraction value Na is determined to be "43".

To check whether the print head 35 is overheating, the current content of the dot-number memory 88 is compared with a predetermined reference value Ns stored in a reference-value memory 94 of the ROM 82. This reference value is equivalent to a permissible upper limit of the temperature of the print head 35. Beyond this temperature, print head 35 does not print properly. In this embodiment, the reference value Ns is set at "820,000".

The RAM 84 also has a special-print flag 96 which is set to "1"when the current content of the dot-number memory 88 has exceeded the predetermined reference value Ns of "820,000" (dots) stored in the reference-value memory 94. If the special-print flag 96 is set to "1", the print head driver circuit 34 and the carriage driver circuit 36 are controlled so that the line of characters in question is printed in a special printing mode, that is, the characters in that line are printed in plural movements of the print head 35.

Moreover, the temperature sensor 51 is connected to the CPU 80. The temperature sensor 51 installed inside of the print head 35 continually outputs data concerning the temperature T of the print head 35. The temperature detecting means constitutes the temperature sensor 51.

The print head 35 is designed to print characters in a 24×24 dot-matrix pattern. The CPU 80 is connected to a driver circuit 34 connected to the print head 35. The driver circuit 34 comprises a well known circuit such as that disclosed in U.S. Pat. No. 4,473,311 or U.S. Pat. No. 4,637,742.

The print wires of the print head 35 are selectively activated by means of an electromagnetic device according to dot-matrix pattern data stored in the print buffer 22. The print head 35 is connected to a power supply having sufficient capacity to enable printing of ordinary letters, digits and symbols as required. The CPU 80 is further connected to a carriage driver circuit 36 and to a paper feed driver circuit 40. On the basis of a carriage drive signal, the carriage driver circuit 36 activates a carriage drive motor 38 to move a carriage 39 carrying the print head 35 in forward and backward directions along the line of printing. The paper feed driver circuit 40 is activated by a paper feed signal and, in turn, activates a paper feed drive motor 42 which is connected to the platen 44 which rotates to feed the recording medium perpendicular to the line of printing.

Next, referring to FIGS. 3(*a*)–(*c*), the operation of the dot-matrix printer constructed as described above will be described in detail. For easy understanding, steps of operation are indicated by step numbers following the letter S.

Upon starting a printing cycle, the CPU 80 executes an initial step S100 to set the dot-number memory 88 at the predetermined value and to start the time-interval counter 90. Step S100 is followed by step S101 in which the special-print flag 96 is reset to "0". Then, the processing goes to step S102 to check whether data has been received from the external device. If data has been received, step S102 is followed by step S103 wherein the CPU 80 checks if the received data is "print start" data which is provided at the end of a set of printing data representing each line of characters. If the received data is not "print start" data, in other words, if the data transferred from the external device is data representing a character to be printed, the processing of the CPU 80 goes to step S104 to store the printing data into the input buffer 20. Then, the CPU 80 executes step S105 to check if the predetermined time interval of 9 msecs. has lapsed. If not, the CPU 80 goes back to step S102. On the other hand, if the predetermined time interval has lapsed, the CPU 80 reads the temperature T of the print head 35 from the temperature sensor 51 at step S106. Step S106 is followed by step S107 wherein the CPU 80 reads the reference temperature Ts from the reference temperature data memory 17 and judges if the temperature T has exceeded the reference temperature Ts. If the temperature T of the print head 35 has exceeded the reference temperature data Ts, the processing of the CPU 80 goes to step S108. At step S108, the CPU 80 subtracts the subtraction value Na stored in the subtraction-value memory 92 from the printing dots value N, having an initial value "0", stored in the dot-number memory 88 and returns to step S102. On the other hand, if the temperature T of the print head 35 is the reference temperature data Ts or less, at step S107, the CPU subtracts twice the subtraction value Na, namely 2Na, from the printing dots value N at step S109 and returns to step S102.

In the case where the checking in step S102 reveals that no data has been received, step S102 is directly followed by step S105 to check for the lapse of 9 msecs. If no data has been received for a long time and the content of the dot-number memory 88 is zeroed, the content is held at zero. Namely, the content of the memory 88 will not be a negative value. With the above steps S102 through S109 repeated, a set of printing data representing a line of characters is stored the input buffer 20. In the meantime, the CPU 80 subtracts the subtraction value, Na or 2Na, wherein the subtraction value is determined according to the temperature T of the print head 35 sensed by the temperature sensor 51.

When "print start" data has been transferred from the external device, the result of checking in step S103 is yes, the processing of the CPU 80 goes to step S110 to store the dot-matrix pattern data into the print buffer 22 after retrieving, from the dot-matrix pattern memory 16, dot-matrix pattern data corresponding to the printing data stored in the input buffer 20. Then the processing of the CPU 80 goes to step S111 to check if the current content of the dot-number memory 88 has exceeded the reference value, i.e., "820,000", stored in the reference-value memory 94. If the current content of the dot-number memory 88 has not exceeded the reference value, step S111 is followed by step S112 wherein the CPU 80 retrieves, from print buffer 22, the dot-matrix pattern data corresponding to the first vertical row of dots of a dot-matrix pattern of the first character to be printed. Step S112 is followed by step S113 to add to the current content of the dot-number memory 88 the number of dots which are formed according to the dot-matrix pattern data which has been retrieved from the print buffer 22 in step S112. Subsequently, the CPU 80 executes step S114 to check if the special-print flag 96 has been set at "1" or not. Since the judging in step S111 is negative and the special-print flag 96 has not been set at "1", step S114 is followed by step S115 wherein the print head driver circuit 34 is controlled so as to active all the print wires that should be pushed against the recording medium to form dots at the intended positions in the first row of the appropriate dot-matrix pattern. Namely, the printing of the first row is effected in a normal print mode.

Step S115 is followed by step S116 to check if the predetermined time interval of 9 msecs. has passed or not. If the time interval of 9 msecs. has lapsed, the CPU 80 executes the same process as described for steps S106–S109. Namely, at steps S117–S120 the CPU 80 uses one of the subtraction values Na, 2Na corresponding to the temperature T of the print head 35 to determine the printing dots value N. The temperature T of the print head 35 is read from the temperature sensor 51 at step S117. At step S118, it is determined if the temperature T has exceeded the reference temperature data Ts. If it is determined that the temperature T of the print head 35 has exceeded the reference temperature data Ts, the processing of the CPU 80 goes to step S119 wherein the CPU 80 subtracts the subtraction value Na from the printing dots value N stored in the dot-number memory 88. On the other hand, if it is determined at step S118 that the temperature T of the print head 35 is equal to or less than the reference temperature data Ts, the processing of the CPU 80 goes to step S120 wherein the CPU 80 subtracts twice the base subtraction value Na, that is, 2Na, from the printing dots value N stored in the dot-number memory 88.

Steps S119 and S120 are followed by step S121 to check if all of the characters of one line represented by the dot-matrix pattern data in the print buffer 22 have been printed. If there are some characters of the same line remaining, the result of checking in Step S121 is no, and the processing of the CPU 80 goes back to Step 112.

If the result of checking in step S116 is no, step S116 is followed by step S121. Since only the first dot row of the first character has been printed at this point in time, the result of checking in S121 is negative and the processing of the CPU 80 goes back to step S112 to form the second row of dots of the first character. Thus, the above steps S112 through S121 are repeated until all characters in the line have been printed.

Figure 3:
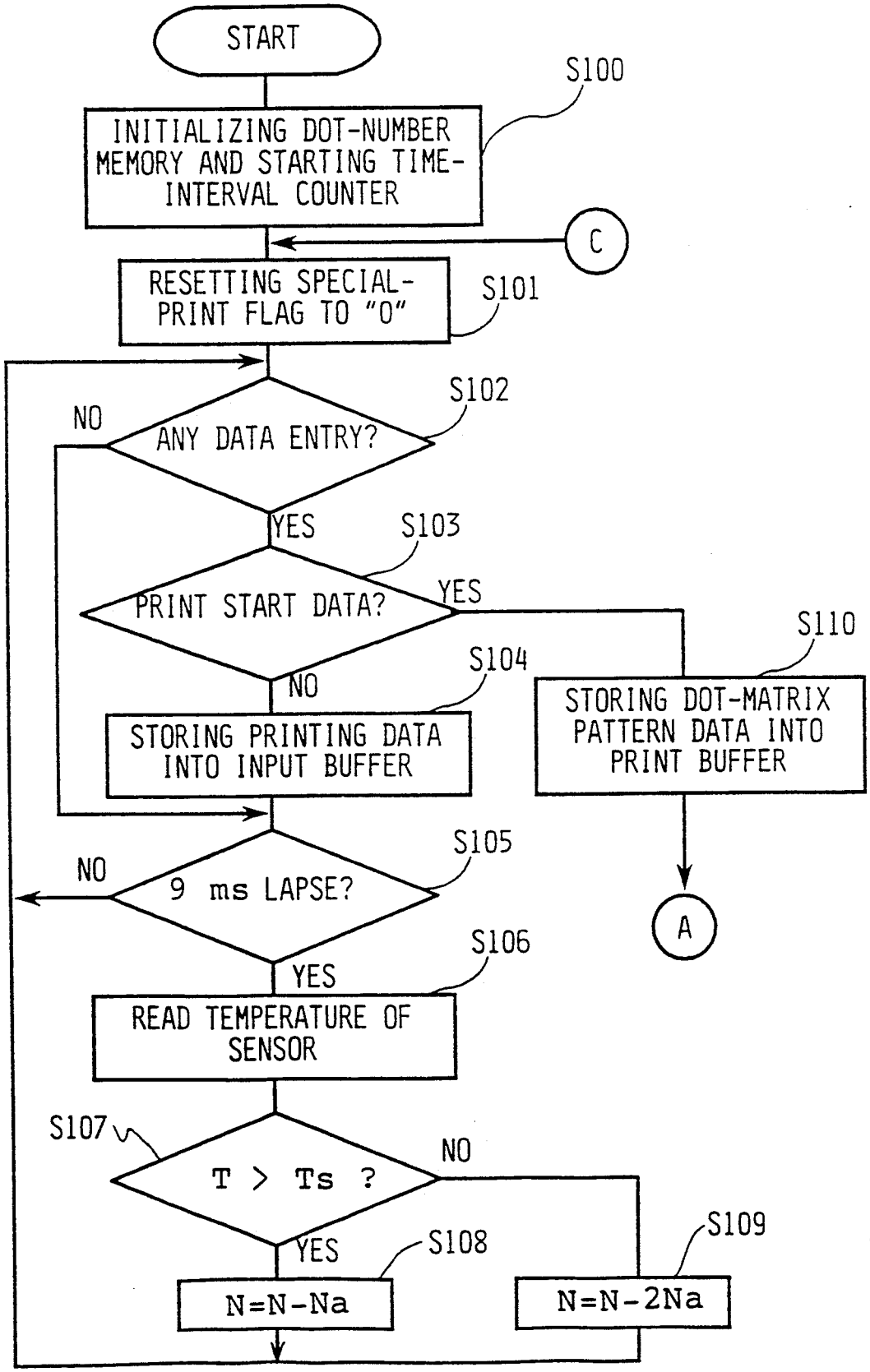
FIGS. 3 (*a*), (*b*) and (*c*) are flow charts showing the operation of the preferred embodiment of the dot-matrix printer.
Figure 3:
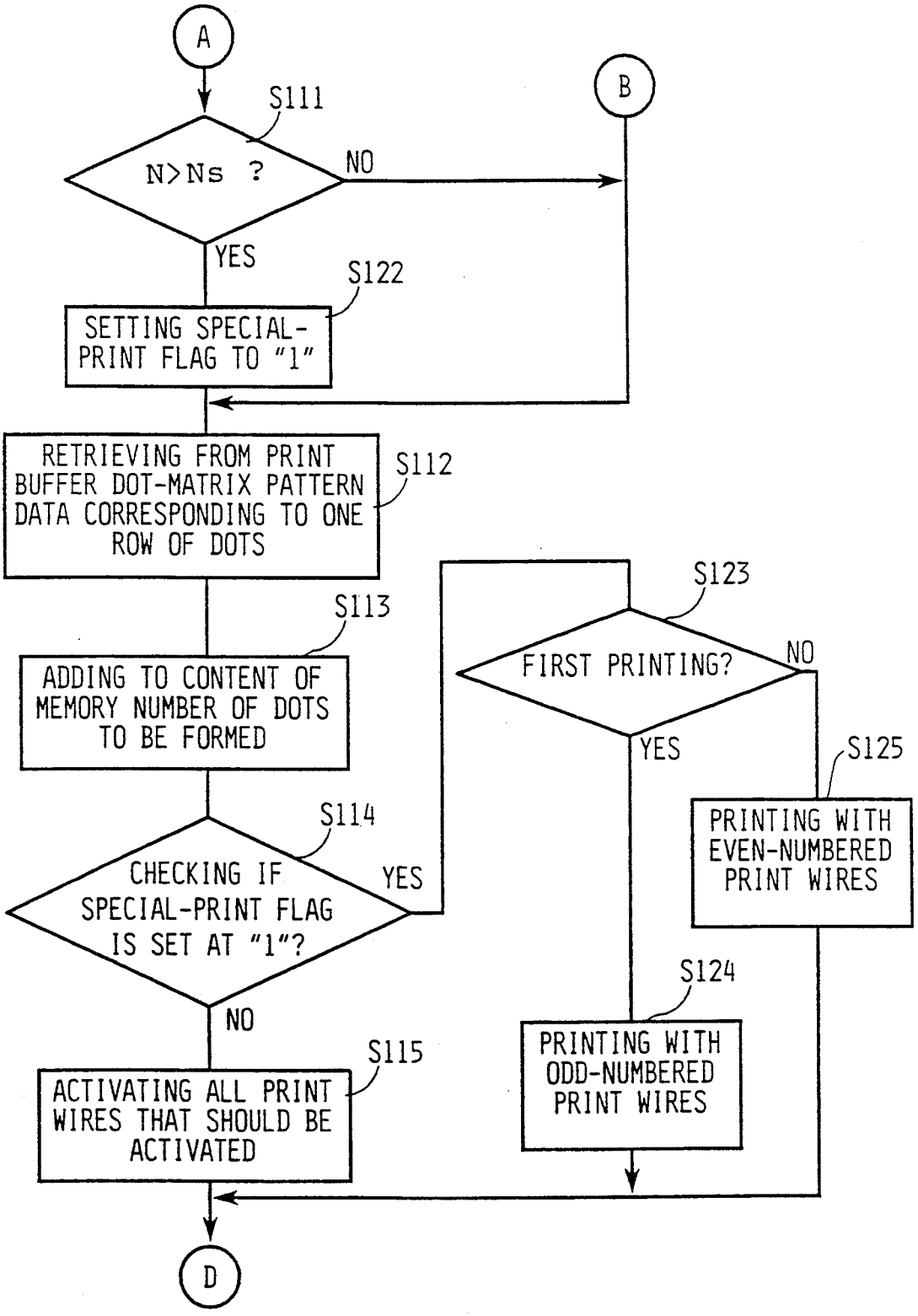
Figure 3:
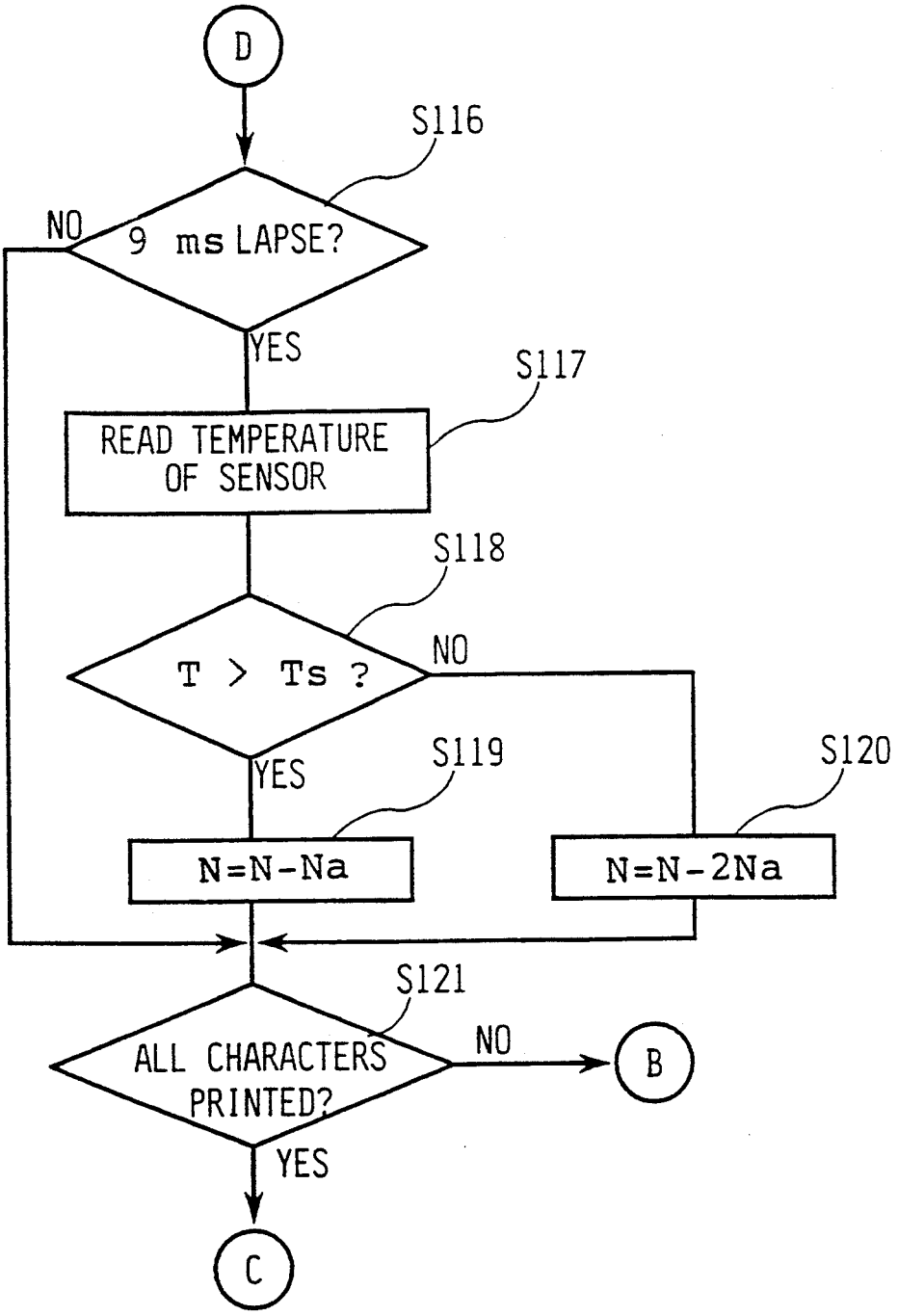

As is apparent from the flow charts of FIG. 3, the numbers of dots to be formed in the individual rows of dots of the characters are added to the current content of the dot-number memory 88 while the printing of the line of characters is in progress. At the same time, the CPU 80 subtracts the subtraction value Na or twice Na, that is, Na, successively from the printing dots value N stored in the dot-number memory 88 according to the temperature T of the printing head 35 whenever the predetermined time lapses.

As described above, the current temperature of the print head 35 is determined during the printing of the line of characters. However, even if the content of the dot-number memory 88 is exceeded during a printing cycle, the printing is continued in the normal printing mode until all characters in the line have been printed.

Upon completion of the printing of all characters in one of the print lines, and the judgment in step S121 becomes affirmative, the processing of the CPU 80 goes back to step S101 to start the printing of the next line of characters.

In the event that the CPU 80 has judged in step S111 that the current content of the dot-number memory 88 exceeds the reference value of "820,000", the special-print flag 96 is set to "1" in step S122. Then, the processing of the CPU 80 goes to steps S112, S113 and S114. In this instance, the judgment in step S114 becomes affirmative, whereby step S114 is followed by step S123 to check if the appropriate row of dots is printed for the first time or not. If the judgment is yes, step S123 is followed by step S124 wherein the print head driver circuit 34 is controlled so as to active only the odd-numbered print wires that should be activated according to the appropriate dot-matrix pattern data. Then, the processing of the CPU 80 goes to step S116–S121 and to step S112. With the steps S112–S114, S123–S124 and S116–S121 executed repeatedly, all rows of dots of the entire print line are printed by activating the odd-numbered print wires according to the dot-matrix pattern data retrieved from the print buffer 22, while the print head 35 is moved along the print line.

When the first printing with the odd-numbered print wires has been completed, the judgment in step S123 becomes negative, and the processing of the CPU 80 goes to step S125 to effect a second printing with only the even-numbered print wires according to the dot-matrix pattern data retrieved from the print buffer 22. By repeating the steps S112–S114, S123, S125, and S116–S121, all rows of dots of the entire print line are printed with only the even-numbered print wires according to the dot-matrix pattern data, while the print head 35 is moved along the print line in the direction opposite to the direction of the first printing. Thus, the second printing is completed. As a result, the judgment in step S121 becomes yes, and the processing of the CPU 80 goes back to step S101.

As described above, if the current content of the dot-number memory 88 has exceeded the reference value of "820,000" stored in the reference-value memory 94 (step S111) and the special-print flag 96 is set to "1" in step S122, the printing of characters in the line is effected in the special printing mode wherein the characters are printed in two movements of the print head 35 along the line of printing. In the first movement, only the odd-numbered print wires of the dot-matrix pattern data are activated In the second movement, only the even-numbered print wires are activated to complete the printing of the appropriate line of characters. This special printing mode permits cooling of the print head 35 and contributes to the prevention of operating failures of the print wires due to overheating of the print head 35. Thus, it assures reliable printing and higher print quality of characters, including graphical representations having a high dot density.

In the present embodiment, the subtraction value to be subtracted from the sum of the printing dots N is changed according to the temperature T of the print head 35. That is, when the temperature T exceeds the reference temperature Ts, the CPU 80 subtracts the subtraction value Na from the current content of the dot-number memory 88. When the temperature T is less than or equal to the reference temperature Ts, the CPU 80 subtracts twice the subtraction value Na, that is, 2Na. Accordingly, when the temperature of the print head has risen little (e.g., just after the power supply is turned on), even if the sum of the printing dots N to be formed by the active print elements is great in number, the printing is executed in the normal mode, because the sum of the printing dots N has not yet exceeded the predetermined reference value Ns. Therefore, the printing speed is the normal speed.

Figure 1:
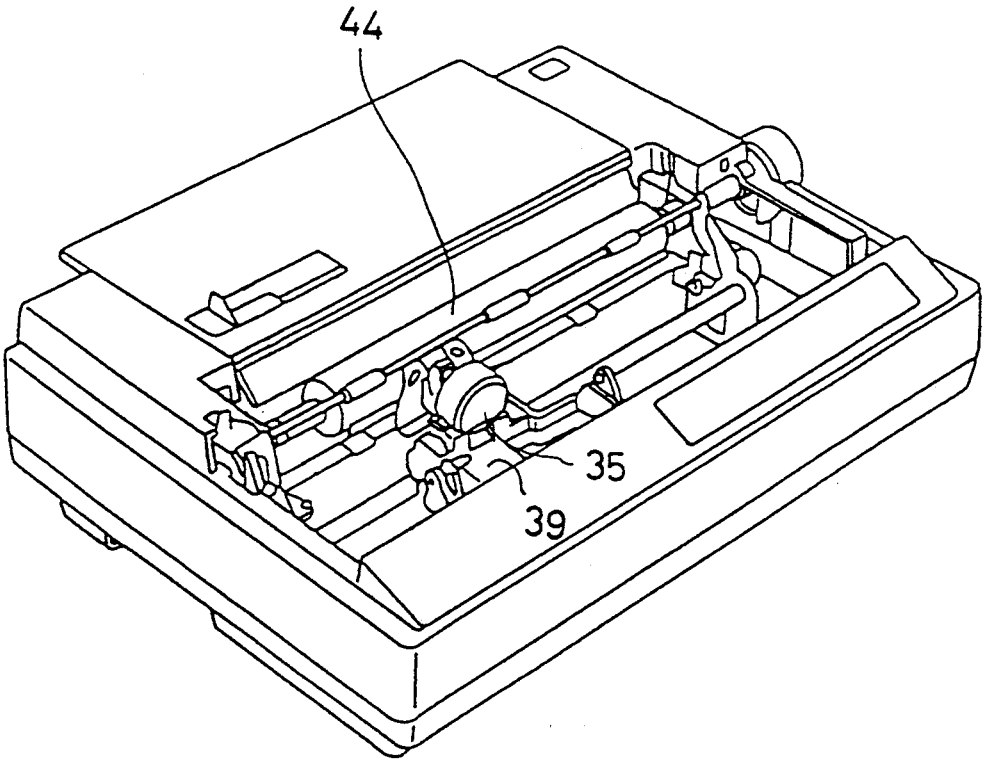
FIG. 1 is a perspective view showing the dot-matrix printer embodying this invention.

It will be understood from the foregoing description and FIGS. 1-3, that: 1) the CPU 80, and a part of the program memory 18 storing the program for executing step S113, constitutes adding means for adding to the current content of the dot-number memory 88 the number of dots which are formed by the print wires during movements of the print head 35; 2) the time-interval counter 90 constitutes a time-measuring means for measuring a time lapse; 3) the CPU 80, the subtraction-value memory 92, and a part of the program memory 18 storing the program for executing steps S106–S109 and S117–S120, constitute a subtracting means for subtracting the predetermined values Na or 2Na from the current content of the dot-number memory 88; 4) the CPU 80, the dot-number memory 88, the reference-value memory 94, and a part of the program memory 18, storing the program for executing step S111, constitute a judging means for checking whether the current content of the dot-number memory 88 has exceeded the predetermined reference value of "820,000"; and 5) the CPU 80, and a part of the program memory 18, storing the program for executing steps S114, S123–S125 and S121, constitute a printing control means for controlling the print head driver circuit 34 and the carriage driver circuit 36 so as to cool the print head 35 when the judgment means has judged that the current content of the dot-number memory 88 has exceeded the reference value "820,000".

The printing of all characters in a line is effected in the special printing mode only when the special-print flag 96 has been set to "1" (in step S122) and before the printing of that line is initiated in step S112. Namely, printing continues in the normal printing mode, even if the current content of the dot-number memory 88 has exceeded the reference value Na, when the printing of a line is in progress.

In the above described embodiment, one of values Na and 2Na is adopted as based upon the temperature T as sensed by the temperature sensor 51. However, it is possible to adopt one of alternative values N1 and N2 as the subtraction value. In this case, N2 is larger than N1 and the reference temperature Ts need not be fixed data. The reference temperature data Ts may be variable based upon the environment wherein the printer is placed. It is also possible to use alternative subtraction values Ni (i=1, . . . ,n) in a predetermined relationship to Tsi (i=1, . . . ,n).

Further, in the embodiment of FIGS. 3, printing in the special mode consists of a first printing with the odd-numbered print wires and a second printing with the even-numbered print wires. However, it is possible that the special printing may be accomplished with three or more printing actions using a corresponding number of movements of the print head 35 along the print line.

Figure 4:
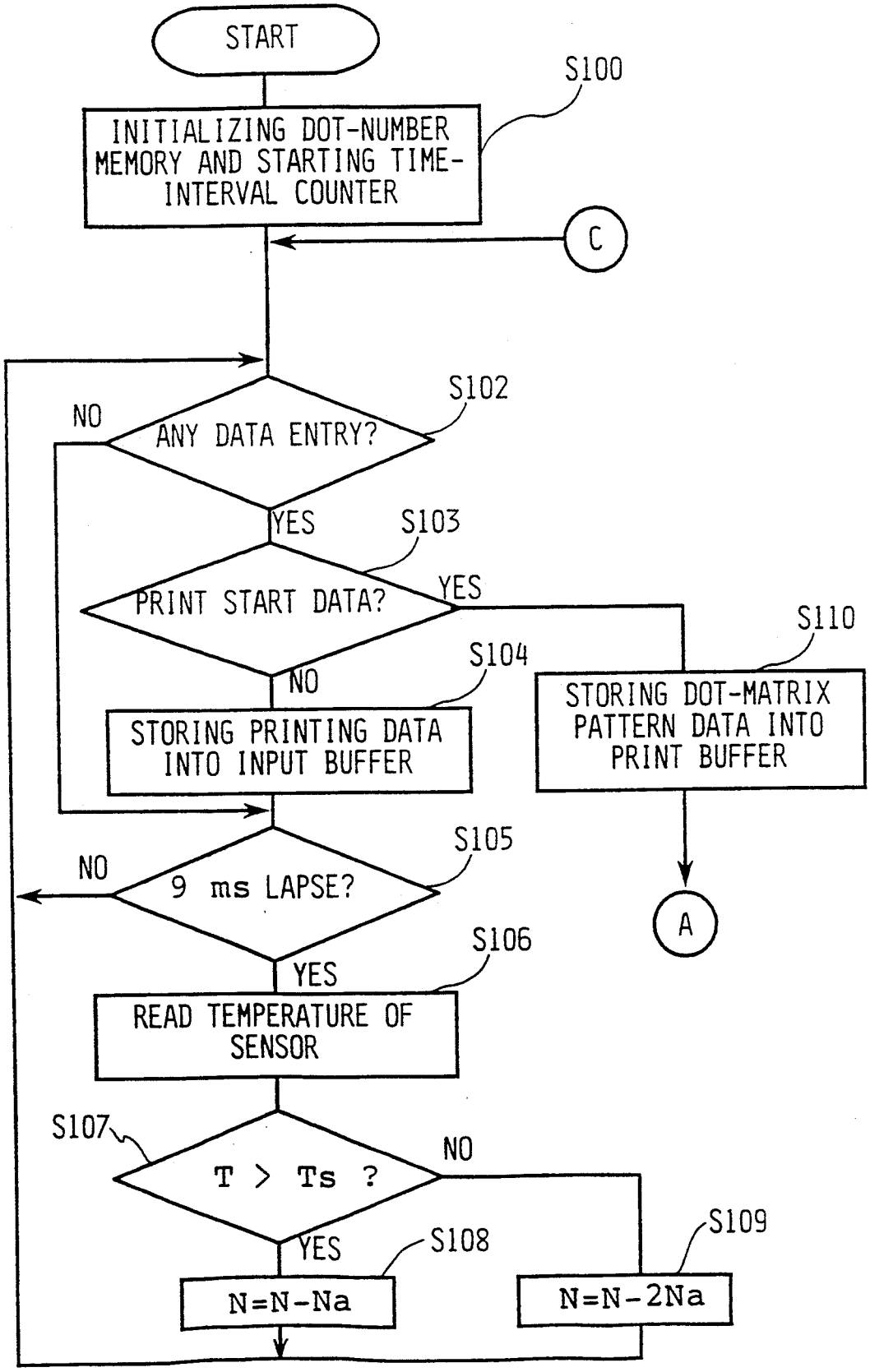
FIGS. 4 (*a*), (*b*) and (*c*) are flow charts showing the operation of an alternative embodiment of the dot-matrix printer.
Figure 4:
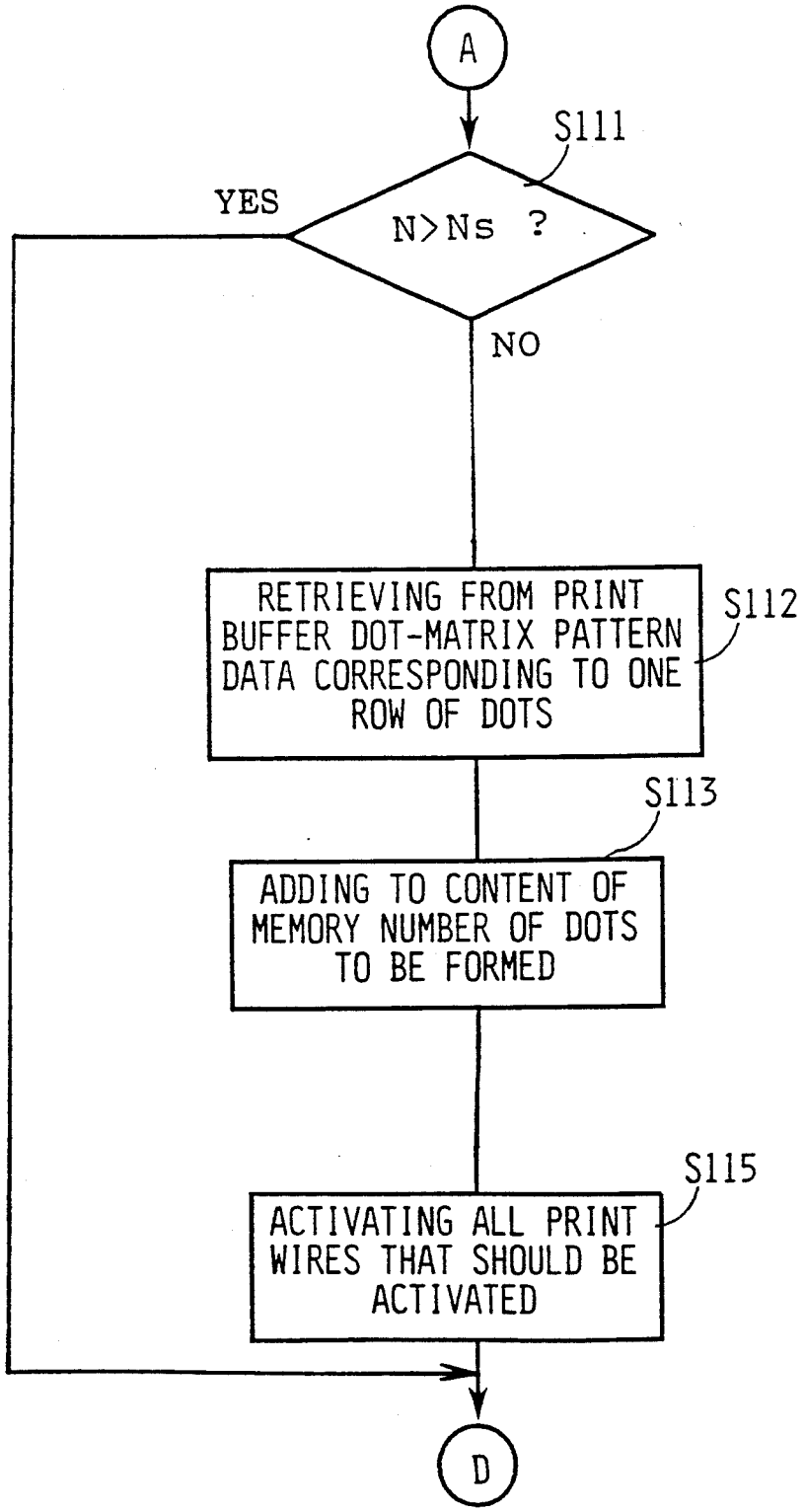
Figure 4:
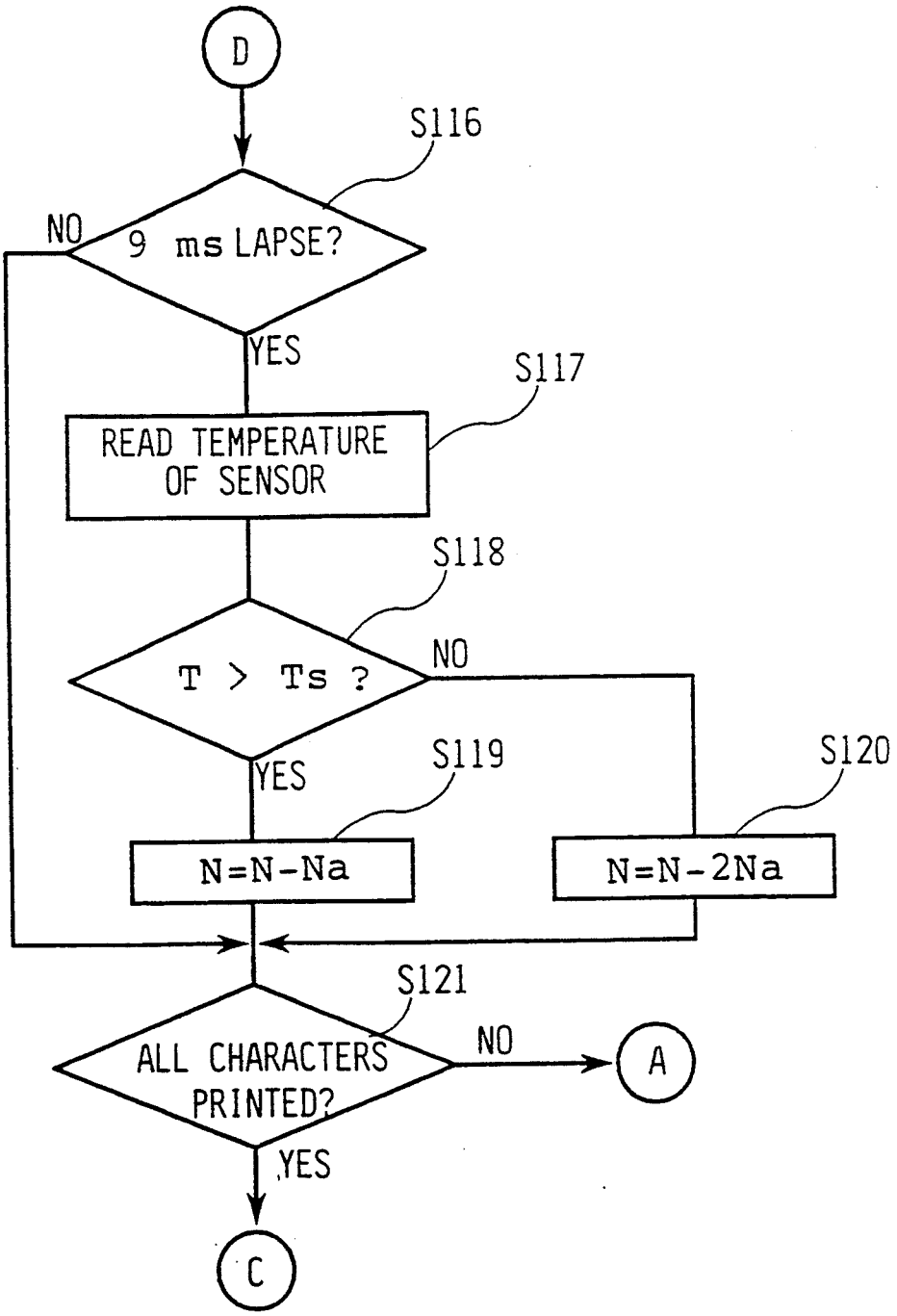

Alternatively, it is possible to discontinue the drive of the print wires and carriage 39 for a short period and then resume normal printing operations as portrayed in FIGS. 4(*a*)–(*c*). In the embodiment shown in FIG. 4, the steps are substantially the same as described with respect to the preferred embodiment of FIGS. 3(*a*)–(*c*). However, in this alternative embodiment, where printing is interrupted to permit the print head to cool, there is no need for step S101 as there is no special printing mode. Further, there is no requirement for steps S122, S114 and S123–S125 for the same reason. In all other respects, this alternative embodiment performs the same manner as that of the preferred embodiment. It is also possible, rather than stop the movement of carriage 39 along the printing line, to only stop forming dots thereby permitting the print head 35 mounted on the carriage 39 to cool. Normal printing operations are resumed after it is determined the print head has cooled.

Wherein, in the described embodiments, the initial value is "0" in the dot-number memory 88, it may be that the initial value is a value corresponding to a temperature detected by the temperature sensor 51.

While the invention has been described in the above embodiments in the form of an impact wire-dot printer, it is to be understood that the invention may be embodied in a thermal-matrix printer or other printers with a print head having plural print elements which are disposed in a row or rows intersecting a line of printing.

It will be obvious to those skilled in the art that other changes, modifications and improvements may be made in the invention in the light of the foregoing teaching, and without departing from the spirit and scope of the invention defined in the appended claims.

What is claimed is:

1. A dot-matrix printer including a print head having plural print elements which are selectively activated, during a movement of the print head, to form a dot or dots in a vertical row of a dot matrix pattern representing a character, comprising:

a dot-number memory;

adding means for adding to a current content of the dot-number memory, numbers of dots which are formed by the print elements during movements of the print head;

time-measuring means for measuring a time lapse;

subtracting means for subtracting a predetermined subtraction value from the current content of the dot-number memory each time the time-measuring means has measured a predetermined time interval;

a temperature detecting means for detecting a temperature of the print head;

a subtraction value changing means for changing said subtraction-value to be subtracted from the current content of the dot-number memory according to the temperature detected by the temperature detecting means;

judging means for checking whether the current content of the dot-number memory has exceeded a predetermined reference value; and printing control means for controlling the print head so as to cool the print head if the judging means has judged that the current content of the dot-number memory has exceeded the predetermined reference value.

2. A dot-matrix printer as claimed in claim 1 wherein said temperature detecting means comprises a temperature sensor.

3. A dot-matrix printer as claimed in claim 1 wherein said time lapse is 9 msec.

4. A dot-matrix printer as claimed in claim 1 wherein said printing control means further comprises means for activating specific groups of print wires during each movement of the print head along a print line such that each time the print head moves along the print line a different group of print wires is activated until a complete line is printed according to appropriate character data.

5. A dot-matrix printer as claimed in claim 1 wherein said printing control means controls the print head to cease printing until said subtracting means has reduced the current content of the dot-number memory below the predetermined reference value.

6. A dot matrix printed as claimed in claim 1, wherein said subtraction value changing means has a comparing means for comparing the temperature from the temperature detecting means to a predetermined temperature and when the temperature is greater than the predetermined temperature selects a first subtraction value and when the temperature is not greater than the predetermined temperature selects a second subtraction value that is larger than the first subtraction value.

7. A dot matrix printer as claimed in claim 6, wherein in the second subtraction value is two times the first subtraction value.

8. A dot matrix printer as claimed in claim 6, wherein the second subtraction value is greater than said first subtraction value and further is a function of the temperature.

9. A process for preventing overheating of the print head of a dot-matrix printer, comprising the steps of:

initializing a dot-number count in a printer memory, adding to a current dot-number count a count of dots which are formed by print elements of the print head during movements of the print head;

measuring a time lapse;

subtracting a predetermined subtraction value from the current dot-number count each time the time-measuring means measures a predetermined time interval;

detecting a temperature of the print head;

changing said subtraction-value to be subtracted from the current dot-number count according to the detected temperature;

judging whether the current dot-number count has exceeded a predetermined reference value; and modifying print operations so as to cool the print head when it is judged that the current dot-number count has exceeded the predetermined reference value.

10. A process as claimed in claim 9 wherein said time lapse is 9 msec.

11. A process as claimed in claim 9 wherein said step of modifying print operations further comprises the steps of activating specific groups of point wires during each movement of the print head along a print line such that each time the print head moves along the print line a different group of print wires is activated until a complete line is printed according to appropriate character data.

12. A process as claimed in claim 9, wherein said step of modifying print operation comprises stopping print operations until the current dot-number count has been reduced below said predetermined reference value.

13. A process as claimed in claim 9, further comprising the steps of:

comparing the detected temperature to a predetermined temperature; and selecting a first subtraction value when the detected temperature is greater than the predetermined temperature and selecting a second subtraction value when the detected temperature is not greater than the predetermined temperature.

* * * * *